US006012803A

United States Patent [19]

Masuda

[11] Patent Number: 6,012,803

[45] Date of Patent: Jan. 11, 2000

[54] IMAGE FORMING APPARATUS FORMING AN IMAGE ON A RECORDING MEDIUM USING JUMPING DEVELOPER

[75] Inventor: Kazuya Masuda, Nara, Japan

[73] Assignee: Sharp Kabushiki Kaisha, Osaka, Japan

[21] Appl. No.: 09/034,389

[22] Filed: Mar. 4, 1998

[30] Foreign Application Priority Data

Mar. 28, 1997 [JP] Japan ..... 9-077625

[51] Int. Cl.[7] ..... B41J 2/06

[52] U.S. Cl. ..... 347/55

[58] Field of Search ..... 347/55

[56] References Cited

U.S. PATENT DOCUMENTS 4,478,510 10/1984 Fujii et al. .

FOREIGN PATENT DOCUMENTS 0 720 072 A2 7/1996 European Pat. Off. .

0 752 318 A1 1/1997 European Pat. Off. .

58-104769 6/1983 Japan .

WO 91/04863 4/1991 WIPO .

OTHER PUBLICATIONS

Copy of European Search Report.

*Primary Examiner*—William J. Royer

*Attorney, Agent, or Firm*—David G. Conlin; William J. Daley, Jr.

[57] ABSTRACT

In an image forming apparatus having a control electrode including gates for allowing toner to pass through them, an image is formed by allowing or disallowing the toner to jump from the toner support to the opposing electrode whilst controlling the electric field near the control electrode elements by applying either 300 V or 0 V to the control electrode from the control electrode voltage source in accordance with image data. Virtual capacitance arising between interconnections associated with the control electrode is limited to or below a predetermined level much lower than the capacitance of the control electrode while the consumed current is maximized under the predetermined conditions.

5 Claims, 6 Drawing Sheets

IMAGE FORMING APPARATUS FORMING AN IMAGE ON A RECORDING MEDIUM USING JUMPING DEVELOPER

BACKGROUND OF THE INVENTION (1) Field of the Invention

The present invention relates to an image forming apparatus such as a digital copier, the printing unit of a facsimile machine, digital printer, plotter etc., and more particularly relates to an image forming apparatus in which an image is formed on a recording medium by causing the developer to jump thereto.

(2) Description of the Prior Art

There has conventionally been known an image forming technique by which electric fields are produced in apertures in accordance with an electric signal to control charged particles passing through the apertures, thus forming a visual image corresponding to the image signal, onto a recording medium such as paper etc.

For example, Japanese Patent Application Laid-Open Sho 58 No. 104,769 discloses an image forming apparatus wherein an image is directly formed on a recording medium by causing charged particles to jump and adhere onto the recording medium by electric force under the application of electric fields whilst varying the voltage which is applied to a control electrode having a plurality of passage holes and placed in the jumping path.

However, in this conventional art, since no consideration has been given to the virtual capacitance which arises at the control electrode when it has been mounted and packaged, this virtual capacitance causes a variety of adverse influences.

For example, if a control electrode has inherent capacitance and virtual capacitance, the combined capacitance of these two may degrade the quality of the image and break down its high withstand voltage driver. Alternatively, there is a risk that the consumed current determined by the capacitance and the voltage could affect a person's body.

Inherently, in an image forming apparatus of this type, which performs electric field control, the power consumption increases in proportion to the capacitance of the control electrode. Therefore, it is preferred that the virtual capacitance is made as low as possible to reduce the power consumption.

Since the control electrode of the image forming apparatus needs interconnections for connecting each of the control electrode elements to the driver source, a shield electrode which is placed opposite the interconnections of the control electrode to shield external noise and radiation noise. Further, the control electrode also needs a fixing means for supporting the control electrode. Accordingly, unexpected virtual capacitance will occur between the control electrode and the lines of the control electrode elements due to these interconnections and fixing means.

Therefore, it is a very critical problem as to how the virtual capacitance, which will change depending upon the material, shape, structure, etc. of the control electrode, is dealt with.

SUMMARY OF THE INVENTION

It is therefore an object of the present invention to solve the above problems and provide an image forming apparatus which can produce images with an improved quality of image while eliminating the adverse effect on a person's body and the risk of breakdown of the high withstand voltage driver etc., caused by the capacitance coupling of the inherent capacitance of the control electrode and virtual capacitance.

In order to achieve the above object, the present invention is configured as follows:

In accordance with the first aspect of the invention, an image forming apparatus has a control electrode including a plurality of control electrode elements with passage holes for allowing charged particles to pass therethrough, wherein an image is formed on a recording medium with charged particles which are made to jump through the passage holes whilst the voltage applied to each control electrode element is being switched, and is characterized in that virtual capacitance arising between interconnections associated with the control electrode is limited to or below a predetermined level much smaller than the capacitance of the control electrode element.

In accordance with the second aspect of the invention, an image forming apparatus has a control electrode including a plurality of control electrode elements with passage holes for allowing charged particles to pass therethrough, wherein an image is formed on a recording medium with charged particles which are made to jump through the passage holes whilst the voltage applied to each control electrode element is being switched, and is characterized in that capacitance Ce of the control electrode element is set so as to have the maximum value under the following requirement:

$$I \geqq Ce \times V \times n/T,$$

where n represents the number of the control electrode element, V the operating voltage of the control electrode, T the driving cycle period and I the consumed current.

In accordance with the third aspect of the invention, an image forming apparatus has a control electrode including a plurality of control electrode elements with passage holes for allowing charged particles to pass therethrough, wherein an image is formed on a recording medium with charged particles which are made to jump through the passage holes whilst the voltage applied to each control electrode element is being switched, and is characterized in that capacitance Ce of the control electrode element is set so as to have the maximum value under the following requirement:

$$BV \times C/(V-BV) \geqq \in 0 \times \in \gamma \times L \times W/D$$

where $\in 0$ is a dielectric constant in vacuum, $\in \gamma$ is the relative dielectric constant of the insulator, L the length of the control electrode elements, D the spacing between control electrode elements, C the capacitance of the control electrode, V the operating voltage of the control electrode, W the thickness of the control electrode element, and BV the reverse withstand voltage.

In accordance with the fourth aspect of the invention, the image forming apparatus having the above second feature is characterized in that the consumed current I is further limited to the following range:

$$I \leqq 70 \text{ (mA)}.$$

In accordance with the fifth aspect of the invention, the image forming apparatus having the above third feature is characterized in that the parametric values relating to the control electrode meets the following condition:

$$70 \text{ (mA)} \geqq Ce \times V \times n/T.$$

where C is the capacitance of the control electrode elements, V the operating voltage of the control electrode, n the number of the control electrode elements, and T is the driving cycle period.

DESCRIPTION OF THE PREFERRED EMBODIMENTS

The embodiment of the invention will hereinafter be described with reference to the accompanying drawings. The description of this embodiment will be made of a case where the invention is applied to the printer with an image forming unit using negatively charged toner.

Figure 1:
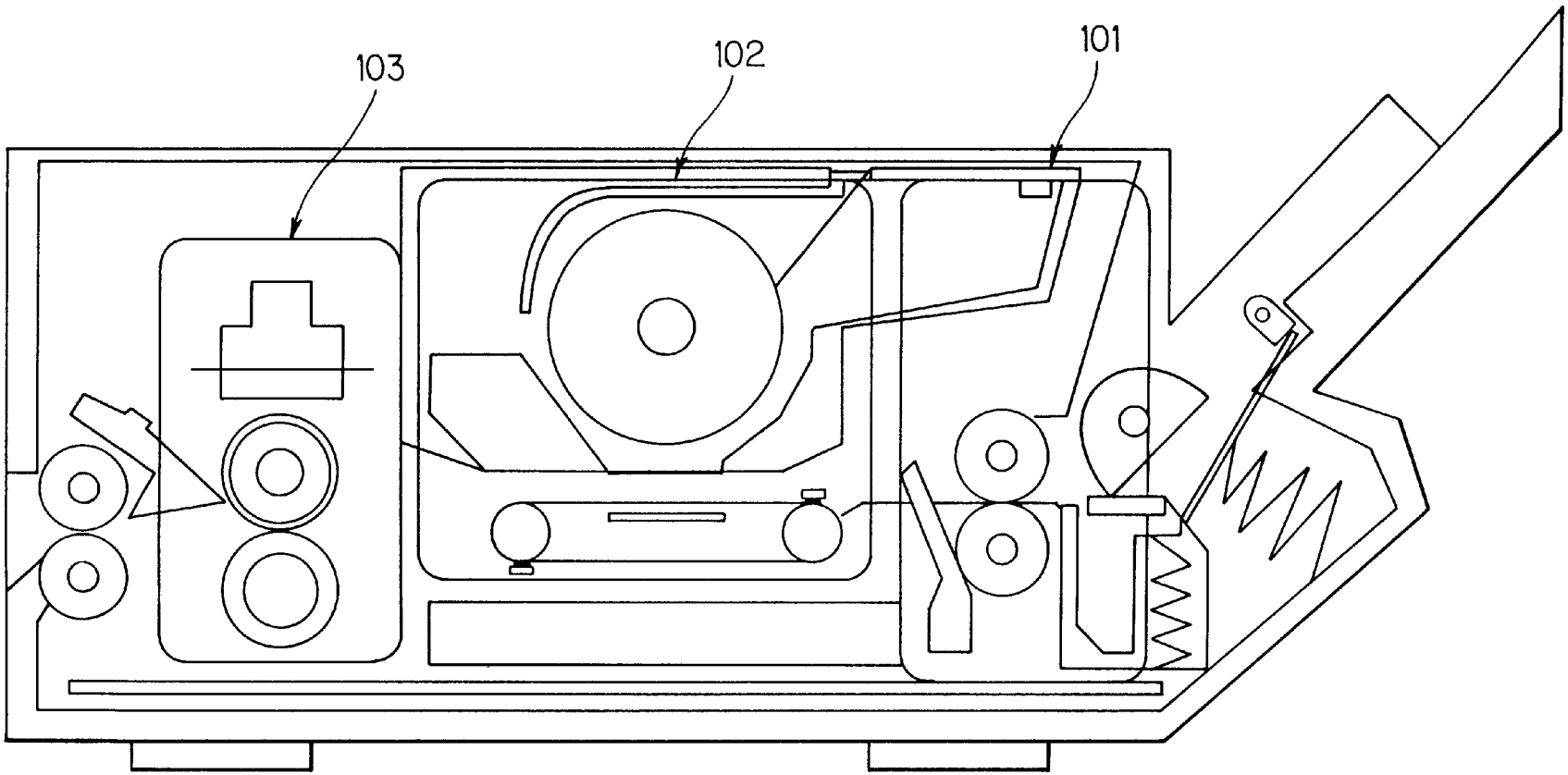
FIG. 1 is a sectional view showing an image forming unit used in the embodiment.

FIG. 1 is a sectional view of an image forming unit used in this embodiment. As shown in the figure, this image forming unit has a paper feeder 101 on the input side thereof. This paper feeder picks up a sheet of paper, as the recording medium, from a paper cassette and delivers it to a printing section 102.

Printing section 102 receives this paper and produces a visual image, in accordance with an image signal sent from a host computer, onto the paper, using toner as the developer.

A fixing unit 103 receives the paper with a visual image developed thereon from printing section 102, and heats and presses the toner image formed on the paper, so as to fix the image to the paper.

Figure 2:
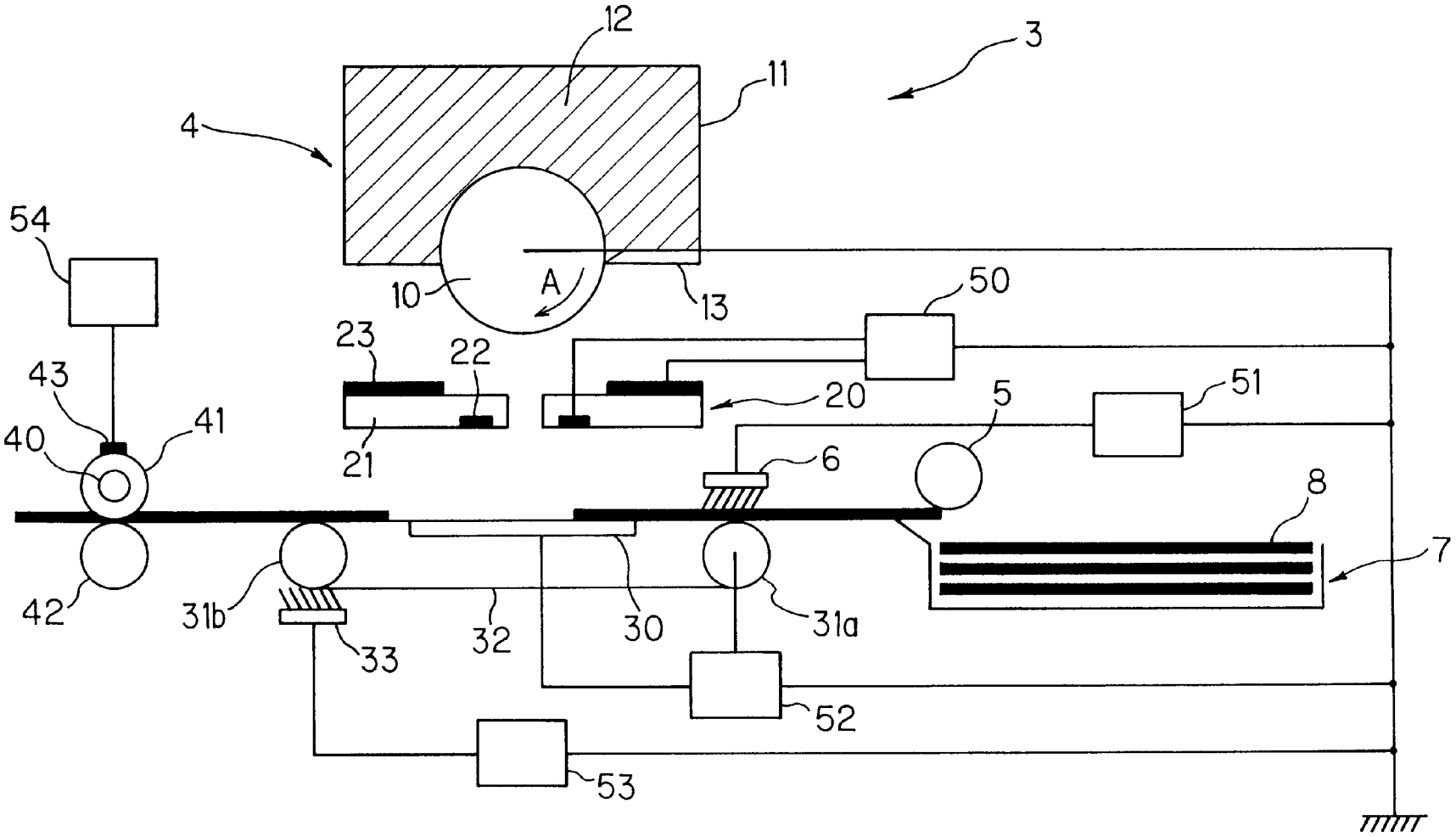
FIG. 2 is a schematic view showing the configuration of an image forming unit used in the embodiment.

Next, a specific configuration of the image forming unit used in this embodiment will be described. FIG. 2 is a schematic diagram showing the configuration of an image forming unit 3 to be used in this embodiment. As shown in FIG. 1, printing section 102 forms a visual image on paper 8 as the recording medium, using toner 12 as the developer, in accordance with an image signal from the host computer. That is, in this image forming unit 3, the jumping of toner 12 is controlled based on the image signal, thus directly forming the image on paper 8.

Paper feeder 101 is composed of a paper cassette 7 for storing paper 8, a pickup roller 5 for delivering paper 8 from paper cassette 7, an unillustrated paper guide for guiding fed paper 8 and a pair of resist rollers.

Paper feeder 101 further has an unillustrated detecting sensor for detecting the feed of paper 8. Pickup roller 5 is rotationally driven by an unillustrated driving means.

Fixing unit 103 is composed of a heater 40 of a halogen lamp, a heat roller 41 made up of an aluminum tube of 2 mm thick, a pressing roller 42 of silicone resin, a temperature sensor 43 for measuring the surface temperature of heat roller 41, a temperature control circuit 54 which performs the on/off control of heater 40 based on the measurement of temperature sensor 43 to maintain the surface temperature of heat roller 41 at 150° C., for example, and an unillustrated paper discharge sensor for detecting the discharge of paper 8. This heat roller 41, pressing roller 42 and the feed roller are driven by an illustrated driving means.

Heat roller 41 and pressing roller 42 which are arranged opposite to each other, are pressed against one another in order to hold paper 8 in between and press it, with a pressing load, e.g. 2 kg, from unillustrated springs etc., provided at both ends of their shafts.

Neither the materials of heater 40, heat roller 41, pressing roller 42 nor the surface temperature of heat roller 41 are particularly limited. Further, fixing unit 103 may have a fixing configuration in which the toner image is either only heated or pressed to affix itself to paper 8.

Although unillustrated, provided on the output side of paper 8 from fixing unit 103 are paper discharge rollers for discharging paper 8 which has been processed through fixing unit 103 onto a paper output tray and a paper output tray for receiving the discharged paper 8.

A toner supplying section 4 is composed of a toner storage tank 11 for storing toner 12 as the developer, a toner support 10 of a cylindrical sleeve for magnetically supporting toner 12, and a doctor blade 13 which is provided inside toner storage tank 11 to electrify toner 12 and regulate the thickness of the toner layer carried on the peripheral surface of toner support 10. Doctor blade 13 is arranged on the upstream side with respect to the rotational direction of toner support 10, spaced at a distance of about 60 ||m, for example, from the peripheral surface of toner support 10.

Toner 12 is of a magnetic type having a mean particle diameter of, for example, 6 $\mu$m, and is electrified with static charge of −4 $\mu$C/g to −5 $\mu$C/g by doctor blade 13.

Here, none of the distance between doctor blade 13 and toner support 10 and the mean particle size and amount of static charge, etc., of toner 12 is particularly limited.

Toner support 10 is rotationally driven by an unillustrated driving means in the direction indicated by arrow A in the drawing, with its surface speed set at 80 mm/sec, for example. Toner support 10 is grounded and has unillustrated fixed magnets therein, at the position opposite doctor blade 13 and at the position opposite a control electrode 20 (which will be described later). This arrangement permits toner support 10 to carry toner 12 on its peripheral surface.

Toner 12 supported on the peripheral surface of toner support 10 is made to stand up in 'spikes' at the areas on the peripheral surface corresponding the above positions of the magnets. The rotating speed of toner support 10 is not particularly limited, and toner 12 may be supported by electric force or combination of electric and magnetic forces, instead of being supported by magnetic force.

The printing section includes: an opposing electrode 30 which is made up of an aluminum sheet of, for example, 1 mm thick and faces the peripheral surface of toner support 10; an opposing electrode voltage power source 52 for supplying a high voltage to opposing electrode 30; a control electrode 20 provided between opposing electrode 30 and toner support 10; a charge erasing brush 33; a charge erasing voltage power source 53 for applying a charge erasing voltage to charge erasing brush 33; a charging brush 6 for charging paper 8; a charger voltage power source 51 for supplying a charger voltage to charging brush 6; a dielectric belt 32; and a pair of support rollers 31*a* and 31*b* for supporting dielectric belt 32.

This opposing electrode 30 is provided 1.1 mm, for example, apart from the peripheral surface of toner support 10. Dielectric belt 32 is made of PVDF as a base material, and is 75 μm thick with a volume resistivity of about $10^{10}$ Ω·cm. This dielectric belt is rotated by an unillustrated driving means in the direction of the arrow in the drawing, at a surface speed of, for example, 30 mm/sec.

Applied to opposing electrode 30 is a high voltage, e.g., 2.3 kV from opposing electrode voltage power source 52. This high voltage generates an electric field between opposing electrode 30 and toner support 10, required for causing toner 12 being supported on toner support 10 to jump toward opposing electrode 30.

Charge erasing brush 33 is pressed against dielectric belt 32 at a position downstream of control electrode 20, relative to the rotational direction of dielectric belt 32.

Charge erasing brush 33 has a charge erasing potential of 2.5 kV applied from charge erasing voltage power source 53 so as to eliminate unnecessary charges on the surface of dielectric belt 32.

None of the material of opposing electrode 30, the distance between opposing electrode 30 and toner support 10, the rotational speed of the opposing electrode and the voltage to be applied thereto is particularly limited.

Control electrode 20 is disposed in parallel to the tangent plane of the surface of opposing electrode 30 and spreads two-dimensionally facing opposing electrode 30, and it has a structure to permit the toner to pass therethrough from toner support 10 to opposing electrode 30.

The electric field formed between toner support 10 and opposing electrode 30 varies depending on the potential being applied to control electrode 20, so that the jumping of toner 12 from toner support 10 to opposing electrode 30 is controlled.

Control electrode 20 is arranged so that its distance from the peripheral surface of toner support 10 is set at 100 μm, for example, and is secured by means of an unillustrated supporter member.

Thus, the specific configuration of image forming unit 3 is constructed as described heretofore.

Next, the structure of the control electrode of the above image forming unit 3 will be described.

Figure 3:
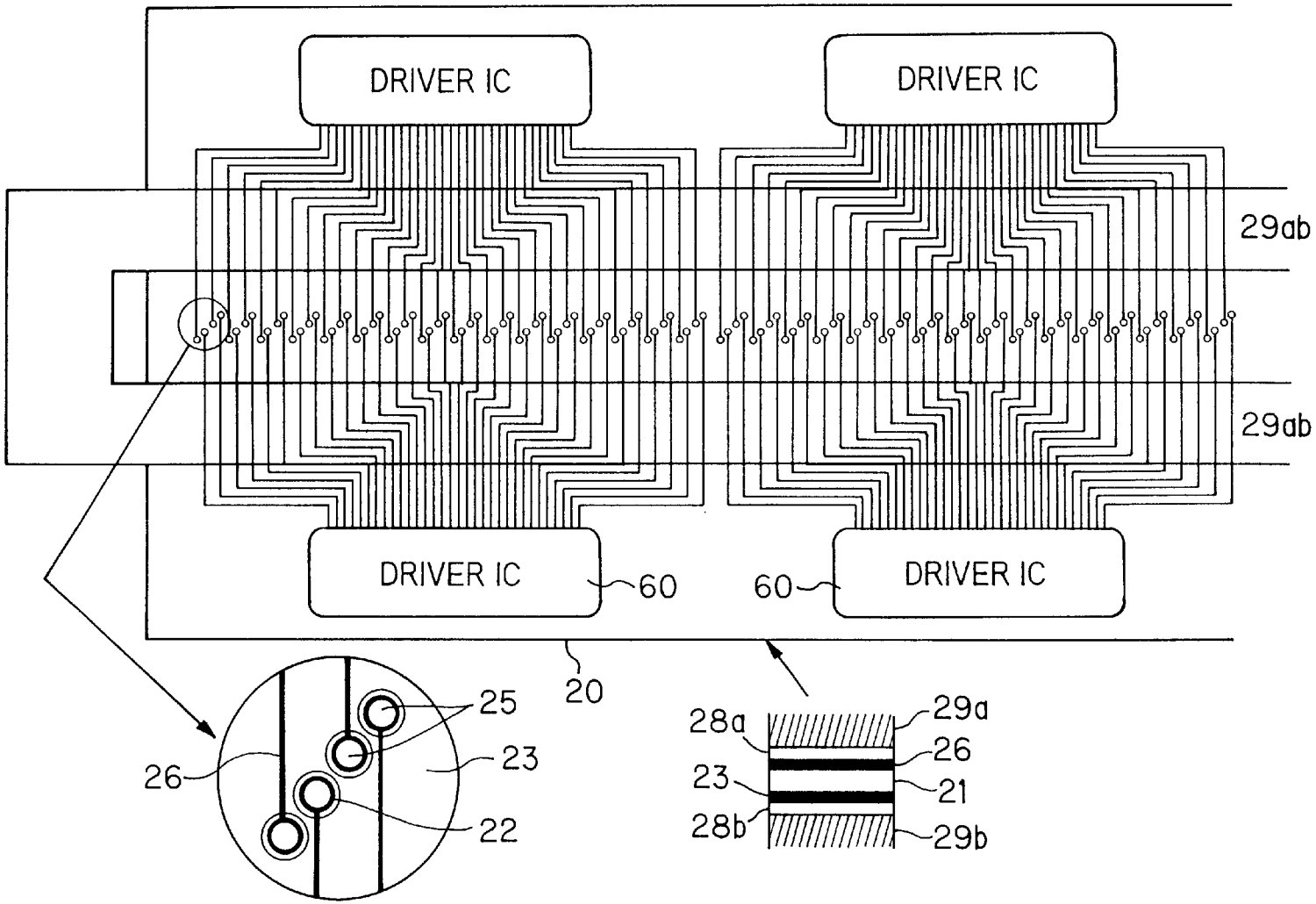
FIG. 3 is a diagram showing the structure of a control electrode of the image forming unit shown in FIG. 2.

FIG. 3 is a diagram showing the structure of the control electrode of image forming unit 3 shown in FIG. 2. As shown in detail in FIG. 3, control electrode 20 is composed of an insulative board 21, a high voltage driver 60, and a plate-like shield electrode 23 having openings provided corresponding to annular conductors independent of one another, i.e., annular electrodes 22.

Insulative board 21 is made from a polyimide resin, for example, with a thickness of 25 μm. Insulative board 21 further has holes forming gates 25, to be mentioned later.

Annular electrodes 22 are formed of copper foil, for instance, and are arranged around the aforementioned holes in a predetermined layout. Each opening of the holes is 160 μm in diameter, forming a passage for toner 12 to jump from toner support 10 to opposing electrode 30. This passage will be termed gate 25 hereinafter.

The shield electrode 23 is made up of copper foil, for example, and has openings of 220 μm in diameter, at the positions corresponding to gates 25 and annular electrodes 22 provided therearound.

Here, none of the distance between control electrode 20 and the toner support, the size of gates 25, the materials and thickness of insulative board 21, annular electrodes 22 and shield electrode 23 is particularly limited.

The aforementioned gates 25, or the holes formed at annular electrodes 22 are provided at 3,600 sites. Each annular electrode 22 is electrically connected to a control electrode voltage power source 50 via a feeder line 26 and a high voltage driver 60.

Shield electrode 23 is electrically connected to control electrode voltage power source 50 via feeder line 26. It should be noted that the number of annular electrodes 22 is not particularly limited.

The surface of annular electrodes 22, the surface of shield electrode 23 and the surface of feeder lines 26 are coated with an insulative layer 28*a, b* of 25 μm thick, thus ensuring insulation between annular electrodes 22, insulation between feeder lines 26, and insulation between annular electrodes 22 and feeder lines 26, which are not connected to each other. Further, this insulative layer prevents the surface of annular electrodes 22, the surface of shield electrode 23 and the surface of feeder lines 26 from becoming short-circuited with other components or any conductive material. Here, none of the material, thickness etc., of this insulative layer is not particularly limited.

Supplied to annular electrodes 22 of control electrode 20 are voltage pulses in accordance with an image signal from control electrode voltage power source 50. Specifically, when toner 12 carried on toner support 10 is made to pass toward opposing electrode 30, control electrode voltage power source 50 applies a voltage of, e.g., 300 V to annular electrodes 22, while a voltage of 0 V, for example thereto when the toner is blocked to pass.

Applied to shield electrode 23 is 0 V, which is the voltage not allowing toner 12 to jump. This is to prevent toner 12 from transferring onto control electrode 20.

The specific configuration of the control electrode in image forming unit 3 has been illustrated in the foregoing description.

Next, a specific processing operation of the above image forming unit 3 will be described.

First, the main controller of the printer, receiving a signal from an unillustrated host computer, starts the image forming operation. Specifically, the image data or the information from the host computer is binarized in the image processing unit (which will be described later), then the processed data is verified with the layout pattern of control electrode 20 at the detecting section (which will be described later) so as to detect the on/off state for control electrode 20.

The image data as to which the detecting process has been completed is temporarily stored in the memory such as RAM (random access memory).

The main controller of the printer activates an unillustrated driving means. This driving means rotates pickup roller 5thereby sending out a sheet of paper 8 from paper cassette 7 toward image forming unit 3, while the paper sensor detects the state of the paper being correctly fed.

The paper 8 thus sent out by pickup roller 5 is conveyed between charging brush 6 and support roller 31*a*. Applied to support rollers 31*a* and 31*b* is a voltage equal to that of opposing electrode 30, from opposing electrode voltage power source 52.

Charging brush 6 is applied with a charging potential of 1.2 kV from charger voltage power source 51. Charge is supplied to paper 8 due to the potential difference between charging brush 6 and support rollers 31*a* and 31*b*, so that the paper can be conveyed, whilst being electrostatically attracted to dielectric belt 32, to the position in the printing section of image forming unit 3 where the paper faces toner support 10.

Then, control electrode voltage power source 50 supplies voltages to control electrode 20 in accordance with the image data. This voltage application is performed at a time synchronized with the feeding of paper 8 to the printing section by means of charging brush 6.

Control electrode voltage power source 50, based on the image data signal, applies a voltage, either 300 V or 0 V as appropriate, to the elements of control electrode 20 so as to control the electric field near control electrode 20.

Thus, at each of gates 25 in control electrode 20, prohibition or release of jumping of toner 12 from toner support 10 toward opposing electrode 30 is selected as appropriate in accordance with the image data.

During this operation, the toner image corresponding to the image signal is formed on paper 8 which is being conveyed toward the paper output side at a rate of 30 mm/sec by the rotation of support rollers 31*a* and 31*b*.

Paper 8 with a toner image formed thereon is separated from dielectric belt 32 due to the curvature of support roller 31*b* and is fed to fixing unit 103, where the toner image is fixed to the paper.

Paper 8 with a toner image fixed thereon is discharged by the discharge roller onto the paper output tray while the paper discharge sensor detects the fact that the paper has been properly discharged. The main controller of the printer judges from this detection that the printing operation has been properly complete.

By the image forming operation described above, a good image can be created on paper 8.

Since this image forming unit 3 directly forms the image on paper 8, it is no longer necessary to use a developer medium such as photoreceptor, dielectric drum, etc., which were used in conventional image forming apparatuses.

As a result, the transfer operation for transferring the image from the developer medium to paper 8 can be omitted, thus eliminating degradation of the image and improving the reliability of the apparatus. Since the configuration of the apparatus can be simplified needing fewer parts, it is possible to reduce the apparatus in size and cost.

In the control electrode layout diagram shown in FIG. 3, a configuration having 32 outputs from high withstand voltage driver 60 is used, but the number of the outputs should not be limited to this.

Up to now, the specific image forming process of image forming unit 3 has been described.

Next, virtual capacitance in the control electrode will be explained.

In FIG. 3, the output interconnections from high withstand voltage driver 60 are laid out radially, each of which has one annular electrode 22 at its distal end. Shield electrode 23 is opposed to the control electrode interconnections with insulative board 21 in between.

Therefore, capacitance arises which is represented by the following relation:

$$C=\in 0\times\in\gamma\times S/D \quad (1)$$

where $\in 0$ is a dielectric constant (F/m) in vacuum, $\in\gamma$ is the relative dielectric constant of the insulator, S is the overlapping area, and D is the spacing (m).

Similar capacitance arises between a metallic supporter member 29*a,b* and the control electrode interconnections.

Further, virtual capacitance also occurs between the control electrode elements, depending upon the area, i.e. the length of the electrode conductors and the distance, i.e., the spacing between the control electrode elements.

Figure 4:
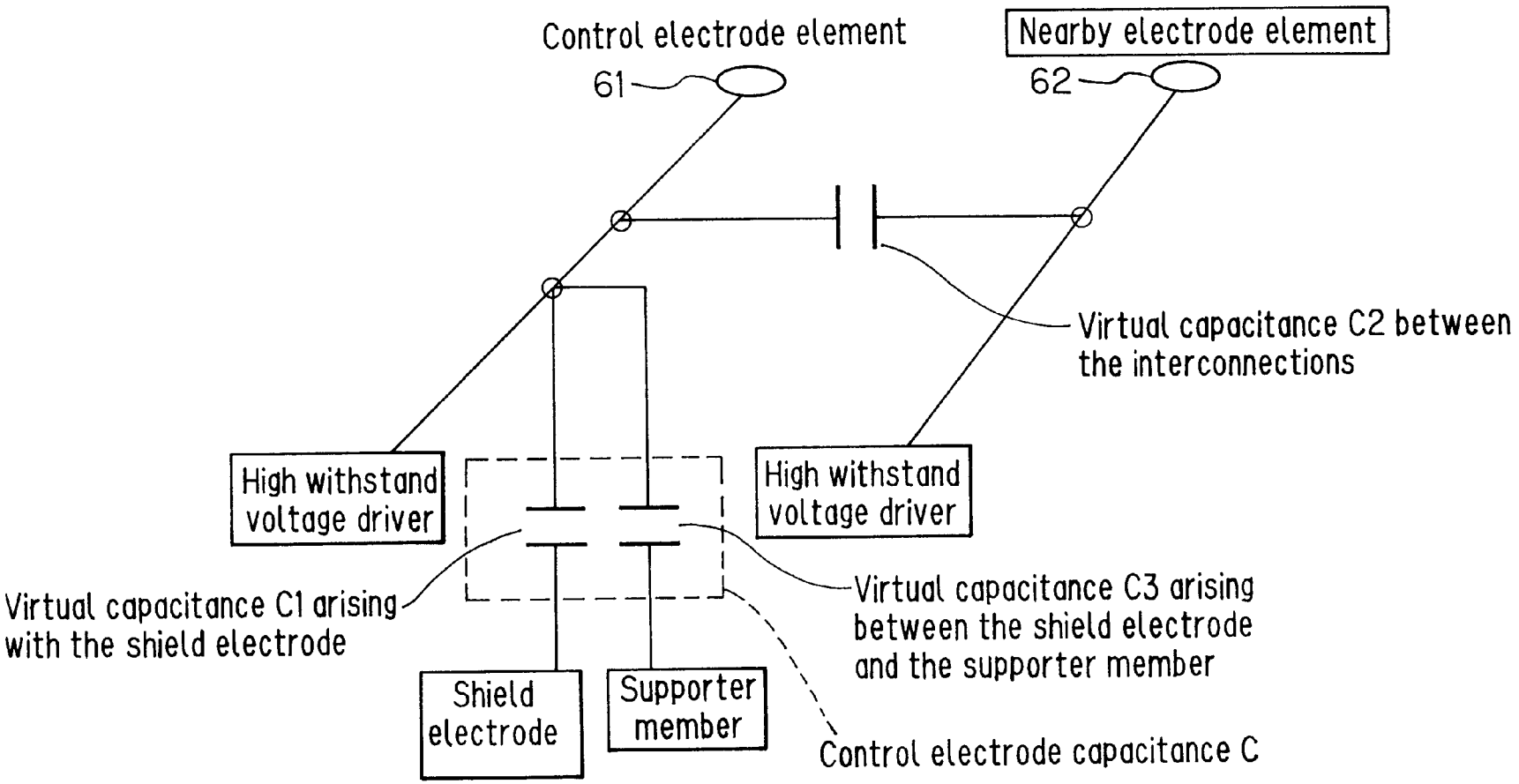
FIG. 4 is an illustrative view showing virtual capacitance in the control electrode of the image forming unit shown in FIG. 2.

FIG. 4 is an illustrative view showing the mechanism of virtual capacitance in the control electrode of image forming unit 3 shown in FIG. 1.

In this figure, the supporter member (made of metal) and the shield electrode are grounded in a typical configuration, and the virtual capacitance derived from each control electrode element can be considered as $$C=C1+C3.$$

Hereinbelow, C will be termed the control electrode capacitance.

Now, consider the relationship between the control electrode capacitance C and the inter-line virtual capacitance C2 where an observed control electrode element 61 is at a certain voltage state and the nearby control electrode element 62 is operated at an operating voltage V and when the high withstand voltage drivers for the two control electrode elements are at the same output impedance state, a voltage Vc which arises at control electrode element 61 can be written as follows:

$$Vc=V\times C2/(C+C2) \quad (2)$$

where Vc represents the coupling voltage (V) and V represents the operating voltage of the nearby control electrode element.

As apparent from equation (2), the voltage Vc will be less influenced by the nearby control electrode element 62 if the control electrode capacitance C becomes greater or if C2 becomes smaller.

Therefore, it is understood that the ideal relationship between the two capacitance values is as follows:

$$C>>C2 \quad (3)$$

Next, the control electrode capacitance in view of the power consumption will be described.

In the case where the output load is of capacitance as in an image forming unit of this kind, the mean value of the consumed current is given as follows:

$$I=Q/T \quad (4)$$

Here, I is the average current (A), Q the amount of charge (C) and T the charge-and-discharge time period (sec).

Since this amount of charge Q is a product of the capacitance C and the applied voltage V, the above equation can be rewritten as the relational expression of the total capacitance as follows:

$$I=C\times V\times n/T \quad (5)$$

Here, C is the control electrode capacitance (F) and n indicates the number of the control electrode elements.

Now, the average current I will be explained. In general, the safety of a high voltage power source critically depends on the current supply capability of the voltage circuit, as understood from the fact that the safety standard for information processing devices (including OA apparatus) laid down by the UL (Underwriters Laboratories Inc.) specifies that the maximum allowable current of the limiting current circuit should be 70 mA or less at its peak value.

This means that the safety of the limiting current circuit, that is, the circuit for regulating the current is guaranteed as long as the current supply capability is low even if the voltage is high. Accordingly, in view of safety, the average current I should fall within the following range:

$$I\leqq 70\times 10^{-3}(A) \quad (6)$$

The ideal capacitance C should satisfy the relations (5) and (6), and substantially take the maximum value, meeting the requirement C>>C2 so as to be advantageous-against the external noise such as from the nearby electrode 62 etc.

Next, the capacitance C of the control electrode and the inter-line virtual capacitance C2 will be described.

Figure 5:
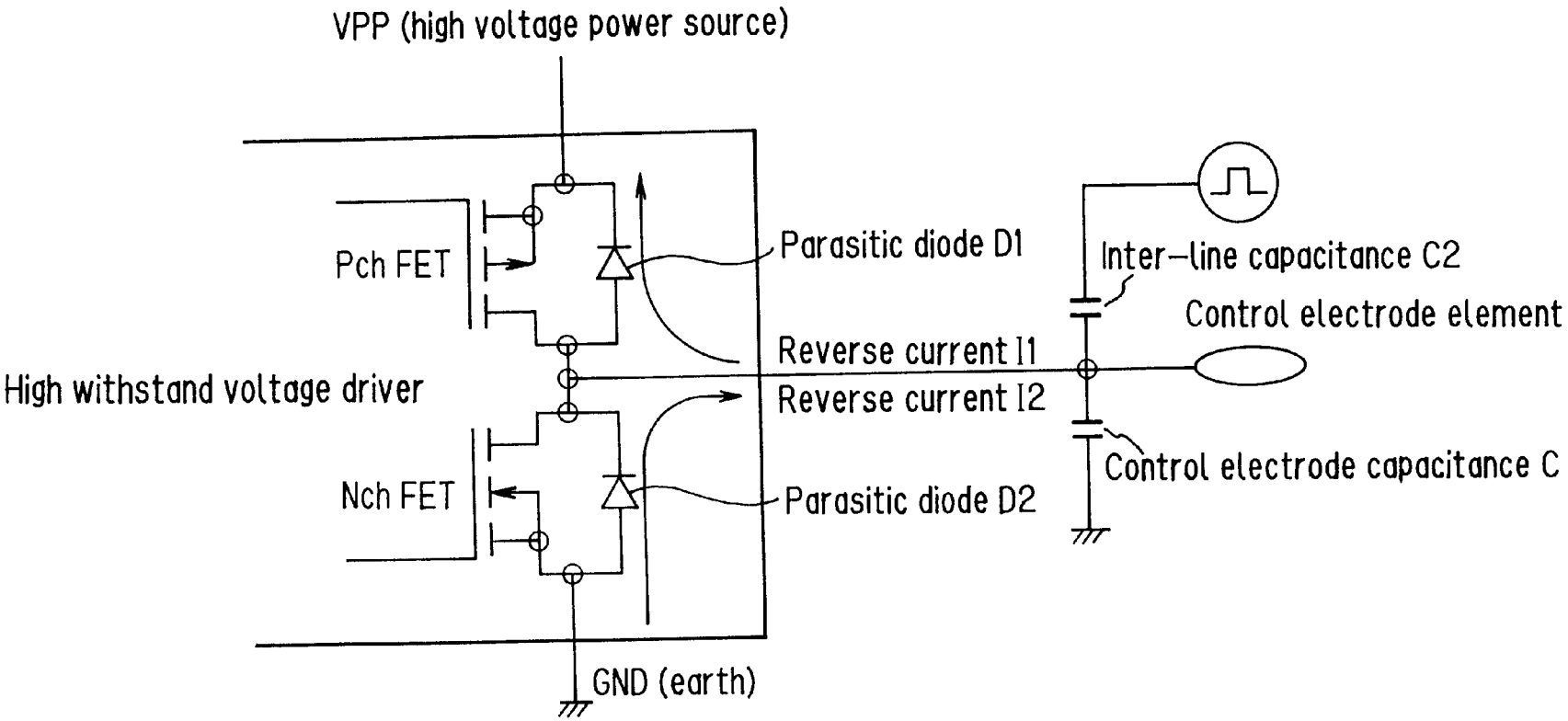
FIG. 5 is an illustrative view showing the relationship between virtual capacitance and a high withstand voltage driver in the control electrode of the image forming unit shown in FIG. 2.

FIG. 5 is an illustrative view showing the relationship between virtual capacitance and a high withstand voltage driver in the control electrode of image forming unit 3 shown in FIG. 2.

In general, when a voltage which is equal to or greater than [(reverse voltage)×VPP+(diode forward voltage)] is applied to the output from a high withstand voltage driver, a reverse current 11 will flow into the VPP high-voltage power source via parasitic diode D1.

Increasing of this current will cause breakdown of the parasitic diodes and/or the IC. Here, the reverse withstand voltage differs depending on the IC, and is not particularly limited.

The coupling voltage which arises from the influence of the nearby electrode, is represented as already shown in the equation (2), $$Vc=V\times C2/(C+C2).$$

When BV represents the reverse withstand voltage of the high-voltage IC, the following relation will be satisfied:

$$BV\geqq V\times C2/(C+C2) \quad (7)$$

This relation (7) can be rewritten as $$C2\leqq BV\times C/(V-BV) \quad (8)$$

C2 must be set equal to or smaller than this threshold.

Therefore, concerning the capacitance of the nearby electrode, the following relation should hold:

$$BV\times C/(V-BV)\geqq \in 0\times \in \gamma\times L\times W/D \quad (9)$$

where $\in 0$ is a dielectric constant (F/m) in vacuum, $\in\gamma$ is the relative dielectric constant of the insulator, L the length of the control electrode elements, D the spacing (m) between the control electrode elements, V the control electrode operating voltage (V), C the control electrode capacitance (F), W the thickness (m) of the control electrode, and BV the reverse withstand voltage (V) of the high withstand voltage IC output.

Next, a practical example will be described.

Suppose that a control electrode for an image forming apparatus having an output capacity of 12 sheets per minute is designed. In this case, under the limiting condition, the following relation holds from relation (5):

$$70\times 10^{-3}=C\times V\times n/T,$$

In this case, with $T=1\times 10^{-3}$, V=300 V and n=3,600, the threshold of the control electrode capacitance can be calculated as:

$$C=64.8 \text{ pF}.$$

This is the threshold of the total capacitance including the high withstand voltage driver. Here, this maximum threshold is adopted under the premise that the power consumption 300 (V)×$70\times 10^{-3}$ (A)=21 W is permissible.

The output capacitance of the high withstand voltage driver is 30 pF and this should be excluded, therefore, 64.8 pF−30 pF=34.8 pF can be assigned for the combined capacitance derived from the supporter member and shield electrode.

Figure 6:
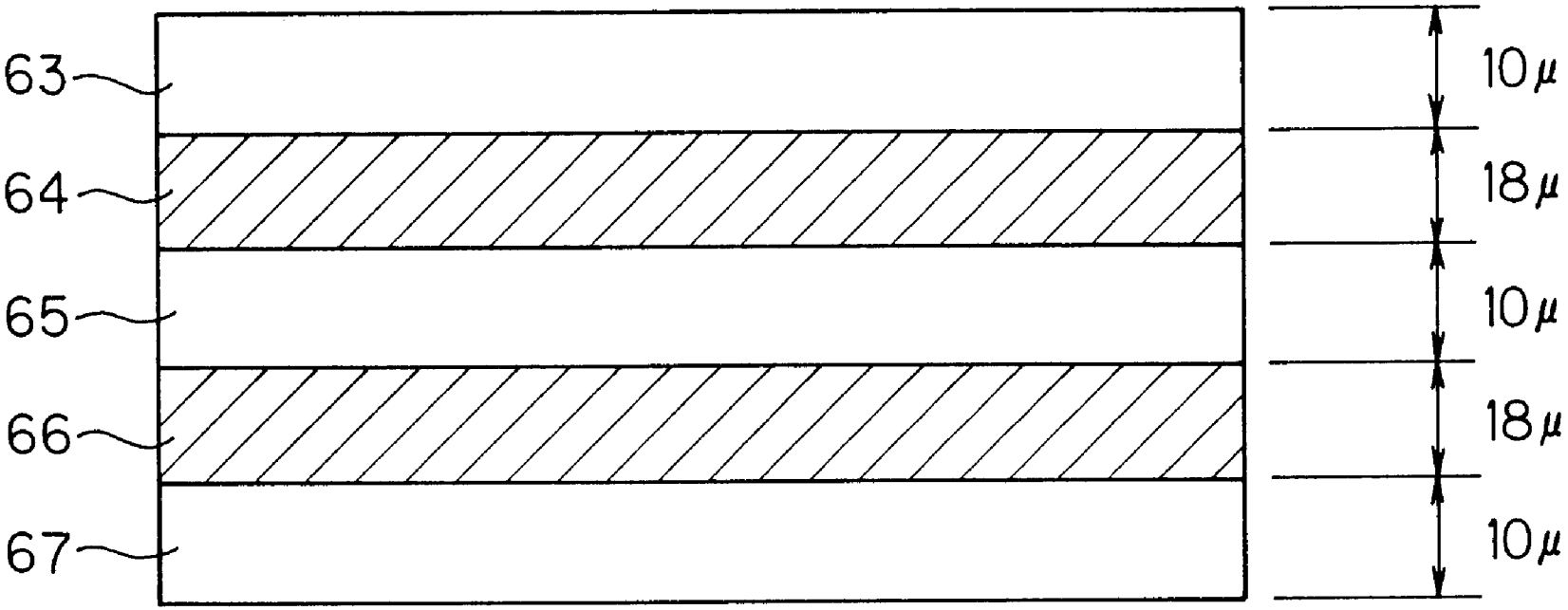
FIG. 6 is a diagram showing a structure of a polyimide FPC constituting the control electrode of the image forming unit shown in FIG. 2.

FIG. 6 is a diagram showing a structure of a polyimide FPC (Flexible print circuit) constituting the control electrode of image forming unit 3 shown in FIG. 2. This FPC structure comprises: a board base 65, a pair of conductors 64 and 66 on both sides of the base and insulative layers 63 and 67 on the respective outer sides. The board base and insulative layers are made from polyimide ($\in\gamma$=3.5).

In this FPC structure, the total area permissible can be calculated from equation (1):

$$C=\in 0\times \in \gamma\times S/D.$$

By substituting $C=34.8\times 10^{-12}$, $\in 0=8.84\times 10^{-12}$, $\in\gamma$=3.5 and D $10\times 10^{-6}$, $S=11.2\times 10^{-6}$ mm$^2$, can be obtained.

Suppose that the conductor width of the control electrode is 90 $\mu$m, the total length of the opposing part may be 0.12 m, which can be allotted, for example, to the shield electrode and the supporter member as follows:

| | |
|---|---|
| Shield electrode | 90 mm |
| Supporter member | 30 mm |
| Total | 120 mm. |

Next, concerning the control electrode structure which would be affected by inter-line capacitance of the neighboring electrodes, in the relation (9):

$$BV\times C/(V-BV)\geqq \in 0\times \in \gamma\times L\times W/D,$$

when it is assumed that the reverse withstand voltage of the high withstand voltage IC is 3.0 V in relation to the other parameters, the threshold can be calculated as follows:

$$0.021153\geqq L\times W/D.$$

Here, when it is assumed that the thickness W of the copper foil is 18 $\mu$m, and the length L of the interconnections to be determined by the physical requirements for the high withstand voltage is 90 mm, the inter-line spacing D should fall within the following range:

$$D\geqq 76.6\ \mu m.$$

Thus, all the conditions of the control electrode may and should be set as follows:

| | |
|---|---|
| Number of control electrode elements | 3600 |
| Printing speed | 1 ms/line |
| Power consumption | 21 W |
| FPC | refer to FIG. 6 |
| Relative dielectric constant of the insulator | not more than 3.5 |
| Control electrode line length | 90 mm |
| Shield length | 30 mm |
| Inter-line spacing | 76.6 pm |

To verify the configuration with the above parametric values, each control electrode element has capacitance of 64.8 pF and there are 3,600 elements, so that the total charge can be estimated as:

$$64.8\times 10^{-12}\times 3{,}600=233{,}280\times 10^{-12}(C)$$

Because the repetition time is 1.0 ms/line, the average current will be $69.98\times 10^{-3}$ A, which is smaller than $70\times 10^{-3}$ A.

Next, the capacitance between control electrode elements is calculated from equation (1) as follows:

$$C2=0.65\times 10^{-12}F$$

Accordingly, the influence upon the nearby electrode element is estimated from equation (7) as follows:

$$BV=2.97937$$

This falls lower than 3.0 V.

Further, because C>>C2 holds, no coupling voltage which could break down the high withstand voltage driver, will occur.

In this embodiment, description has been made of a case where the present invention is applied to a printer having a configuration for negatively charged toner, but the invention should not be limited to this, and can be applied to a printer having configuration for positively charged toner as well as to the image forming apparatuses other than printers.

As has been detailedly described heretofore, in accordance with the image forming apparatus of the first configuration which has a control electrode including a plurality of control electrode elements with passage holes for allowing charged particles to pass therethrough, when an image is formed on a recording medium with charged particles which are made to jump through the passage holes whilst the voltage applied to each control electrode element is being switched, virtual capacitance arising between interconnections in the control electrode can be limited to or below a predetermined value which is much smaller than the capacitance of the control electrode element. Accordingly, it is possible to markedly reduce the influence from capacitance coupling, and hence it is possible to prevent degradation of the quality of image due to the capacitance coupling as well as prevent breakdown of the high withstand voltage driver.

In accordance with the image forming apparatus of the second and fourth configurations which have a control electrode including a plurality of control electrode elements with passage holes for allowing charged particles to pass therethrough, when an image is formed on a recording medium with charged particles which are made to jump through the passage holes whilst the voltage applied to each control electrode element is being switched, capacitance C of the control electrode element is set so as to have the maximum value under the following requirements:

$$I \geqq C \times V \times n/T \text{ and/or } I \leqq 70 \text{ (mA)}$$

where n represents the number of the control electrode element, V the operating voltage of the control electrode element, T the driving cycle period and I the consumed current. As a result, it is to easily determine the threshold level of capacitance against external noise whilst ensuring the personal safety against the consumed current.

In accordance with the image forming apparatus of the third and fifth configurations which have a control electrode including a plurality of control electrode elements with passage holes for allowing charged particles to pass therethrough, when an image is formed on a recording medium with charged particles which are made to jump through the passage holes whilst the voltage applied to each control electrode element is being switched, capacitance C of the control electrode element is set so as to have the maximum value under the following requirements:

$$BV \times C/(V-BV) \geqq \in 0 \times \in \gamma \times L \times W/D \text{ and/or}$$

$$70 \text{ (mA)} \geqq C \times V \times n/T.$$

where $\in\gamma$ is a dielectric constant in vacuum, $\in\gamma$is the relative dielectric constant of the insulator, L the length of the control electrode elements, D the spacing between control electrode elements, V the control electrode operating voltage, W the thickness of the control electrode, and BV the reverse withstand voltage. Accordingly, the geometry, structure and material of the control electrode elements and supporting means, supporting structure, supporting material etc. of the control electrode can be easily determined taking the threshold values into consideration.

What is claimed is:

1. An image forming apparatus having a control electrode including a plurality of control electrode elements with passage holes for allowing charged particles to pass therethrough, wherein an image is formed on a recording medium with charged particles which are made to jump through the passage holes whilst a voltage applied to each of the plurality of control electrode elements is being switched, characterized in that a virtual capacitance arising between interconnections associated with the control electrode is limited to or below a predetermined level much smaller than a capacitance of the control electrode.

2. An image forming apparatus having a control electrode including a plurality of control electrode elements with passage holes for allowing charged particles to pass therethrough, wherein an image is formed on a recording medium with charged particles which are made to jump through the passage holes whilst a voltage applied to each of the plurality of control electrode elements is being switched, characterized in that a capacitance Ce for each of the plurality of control electrode elements is set so as to have a maximum value under the following requirement:

$$I \geqq Ce \times V \times n/T,$$

where n represents a number of the control electrode clement, V an operating voltage of the control electrode, T a driving cycle period and I consumed current.

3. An image forming apparatus having a control electrode including a plurality of control electrode elements with passage holes for allowing charged particles to pass therethrough, wherein an image is formed on a recording medium with charged particles which are made to jump through the passage holes whilst a voltage applied to each of the plurality of control electrode elements is being switched, characterized in that a capacitance Ce for each of the plurality of control electrode elements is set so as to have a maximum value under the following requirement:

$$BV \times C/(V-BV) \geqq \in 0 \times \in y \times L \times W/D$$

where $\in 0$ is a dielectric constant in vacuum, $\in y$ is a relative dielectric constant of an insulator, L a length of the plurality of control electrode elements, D a spacing between control electrode elements, C a capacitance of the control electrode, V an operating voltage of the control electrode, W a thickness of the control electrode element, and BV a reverse withstand voltage.

4. The image forming apparatus according to claim 2, wherein the consumed current I is further limited to the following range $$I \leqq 70 \text{ (mA)}.$$

5. The image forming apparatus according to claim 3, wherein the parametric values relating to the control electrode meets the following condition:

$$70(\text{mA}) \geqq Ce \times V \times n/T.$$

where Ce is the capacitance of the control electrode element, V the operating voltage of the control electrode, n a number of the control electrode elements, and T is a driving cycle period.

* * * * *